US005758588A

United States Patent [19]

Orfali

[11] Patent Number: 5,758,588

[45] Date of Patent: Jun. 2, 1998

[54] GRAFTED TEXTILE PRODUCT AND METHOD FOR GRAFTING THE PRODUCT

[76] Inventor: Isaac Nestor Orfali, Urauiza 971, Ramos Mejia, Prov. of Buenos Aires, Argentina

[21] Appl. No.: 600,001

[22] Filed: Feb. 14, 1996

[51] Int. Cl.[6] ..... D05C 17/00

[52] U.S. Cl. ..... 112/1; 112/405; 428/542.2

[58] Field of Search ..... 112/475.08, 475.09, 112/475.11, 475.12, 475.13, 439, 440, 441, 405, 78, 99, 102, 103, 102.5, 470.06, 470.07, 163; 428/906.6, 542.2

[56] References Cited

U.S. PATENT DOCUMENTS

| | | | |
|---|---|---|---|
| 1,879,695 | 9/1932 | Leissner | 112/405 X |
| 2,791,821 | 5/1957 | Shapiro | 112/405 X |
| 4,597,812 | 7/1986 | Hamilton | 428/542.2 X |
| 5,403,644 | 4/1995 | Fujisawa et al. | 428/906.6 X |

FOREIGN PATENT DOCUMENTS

| | | | |
|---|---|---|---|
| 62-21861 | 1/1987 | Japan | 112/439 |

*Primary Examiner*—Peter Nerbun

*Attorney, Agent, or Firm*—Watson Cole Grindle Watson, P.L.L.C.

[57] ABSTRACT

An applique such as a lace-trimming is grafted onto a region of a textile product, such as a towel or a pair of blue-jeans. Previously, said region is marked by lockstitching on the product base material by means of an embroidering machine and removed therefrom, preferably by cutting or punching in a press. The applique is then bridged onto the removed portion of the base material with only a small overlap thereover and joined thereto by embroidering a seam all the way round the overlap with the machine. The seam is preferably about 4 mm wide and the overlap between 2 mm and 3 mm. A method is disclosed wherein the product is permanently retained in a hoop between the marking and joining steps, through the removing step, thus enabling the product to be uniquely placed relative to the embroidering machine before and after temporary removal to the press.

20 Claims, 2 Drawing Sheets

GRAFTED TEXTILE PRODUCT AND METHOD FOR GRAFTING THE PRODUCT

BACKGROUND OF THE INVENTION

The instant invention concerns textile products made from material such as cloth, leather and plastics. The present invention may be applied to all kinds of fabrics or non-woven products such as towels, clothes and linen in particular, although it is by no means limited to such products. More particularly, the invention refers to base products exhibiting appliques of like or different material grafted on a preselected spot or region thereof, generally for reasons of ornamental design or marketing needs.

The present invention is disclosed hereinafter with reference to a towel which is grafted with an applique of lace trimming to make it more attractive or give it a more distinguished appearance, notwithstanding that the scope thereof spans a broader range of products such as shirts, trousers and table-cloths, for instance. It should be apparent to those skilled in the art how to adapt the present invention from the ensuing disclosure to other applications, such as grafting a lace trimming on the back pocket or legs of a pair of blue-jeans.

SUMMARY OF THE PRIOR ART

When it was desired heretofore to apply an ornamental applique on some region of a towel, said region was simply put into a frame, the applique was temporarily affixed to said region by means of a preglued substrate and an embroidering machine was used thereafter to embroider or sew a seam all around the edge of the applique. Automatic pre-programmed embroidery machines were used for this step wherein the shape of the seam or embroidery was previously designed and stored in a memory chip, generally from a diskette, tape, carton or hard disk recorded on a computer using a computer-aided design (CAD) system or by hand. A technique for this is disclosed, for example, in a manual named "How To Embroider" by Tajima Corp. of Japan.

The above-referred technique results in a visually attractive product although it has some drawbacks, which the present invention aims to improve or overcome, as a result of that the base material of the product and the grafted material of the applique are superposed in the region of the applique of the finished product. That is, two distinct cloth materials superpose one another, such that the product is felt to be thicker in the referred region, which may be uncomfortable to a user or cause a distasteful impression to a potential buyer. Furthermore, both materials may be subjected to unequal stresses which wrinkle this region or hinder ironing the product. Moreover, when the product is washed, the time the grafted region takes to dry is longer, as happens with clothes having an elastic band at the waist, cuffs, etc.

SUMMARY OF THE INVENTION

An object of the present invention is to differentiate and substantially eliminate the superposition of materials in the region of the applique or graft, to overcome the difficulties outlined above and obtain in turn a look-like one-piece woven product having optimum finishing touches and aesthetic appearance.

Another object of the invention is to suggest a relatively simple method for applying the applique, insofar that it comprises a series of extra steps, relative to the method used heretofore, which are relatively easy to carry out for one skilled in the art.

An additional object of the invention is a method for applying the graft which may be implemented by means of a conventionally programmed automatic one-head or multihead embroidering machine, without much difficulty.

Yet another object of the invention is to suggest a method for carrying out the graft which during the different steps thereof maintains a precise registration or alignment between a portion punched or cut out in the material of the product and the graft material, in particular during the step wherein the product is removed from the machine for cutting and removing the portion of base material where the graft is to be applied, so that the joint formed thereafter between the applique and the rest of the product may be effected with millimetric precision, such that there is excess or insufficient material at no point around the edges of the graft that would produce a defective seam or ruin the grafted product.

The above and other objects and advantages that may become apparent from the ensuing disclosure are achieved by starting out with a product, such as a towel, and cutting out a portion of the material thereof in a preselected region to be grafted, preferably having the same shape as the graft or applique. This is done by fitting the product in a hoop or equivalent shuttle frame means big enough to contain the region of the graft and stressing the region taut enough so that it is firm and without play. Thereafter, the preprogrammed shape is marked on the product, inside said region, preferably by lock-stitching with the embroidering machine once the hoop, with the product, has been fitted in a unique position in the machine. The hoop is then removed from the machine together with the marked product for removing the portion surrounded by the marked out shape, such as by means of a press installed with a hollow die cut, preferably of the same shape and slightly smaller size relative to the applique to be grafted. The removed portion is discarded and the hoop, still with the product, is put back into the machine in the same unique position as before.

Terminal steps similar to the prior art-may then carried out to graft the applique in place of the hole left by the removed portion. However, according to another aspect of the invention, the step of grafting or joining the applique to the product includes forming a provisional bridge between the applique and the base product, to keep the applique mated exactly on the hole while embroidering the seam joining the applique to the product. The bridge may comprise a piece of paper or other throw-away substrate which is tacky on the inside so that it sticks to the applique and a surrounding part of the base product during the embroidering step and which, thereafter, may be easily peeled off. Alternatively, the bridge may be placed only while a baste is tacked accross the applique over the hole and extending beyond both edges of the applique, the bridge being peeled off thereafter such that the baste forestalls relative movement between the applique and the base product during the rest of the joining step.

The joint and finishing of the end product are optimum in view of that the overlap resulting from the invention between the applique and the product is minimum and narrower than the seam, hardly noticeable to a person. One of the main features of the invention is that the product is not once removed or otherwise loosened from the hoop between the marking step and the joining step, not even when the product is temporarily removed from the embroidering machine and transferred to and from the press and the discarded portion removed, thus resulting in that the final seam or embroidery is inherently placed and sewn around the graft in exactly the same place as the initial lock-stitching which marks the cut-out shape, both of which follow a unique pattern previously programmed into the embroidering machine.

The method of the instant invention may be carried out on an industrial scale by using embroidery machines installed with one or more spindle heads. The machine and press steps may be intertwined with different products to reduce idle time without loss of placement precision.

BRIEF DESCRIPTION OF THE DRAWINGS

The above-stated and other novel features and aspects of this invention and how it may be reduced to practice may be understood better from the following detailed description of a preferred embodiment shown in the attached drawings, wherein.

DETAILED DESCRIPTION OF A PREFERRED EMBODIMENT

Figure 1:
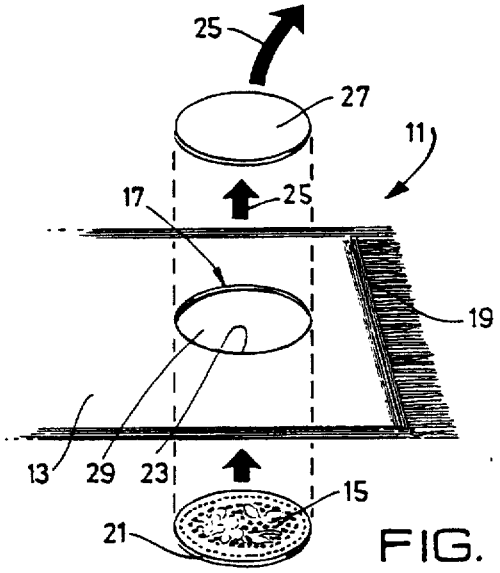
FIG. 1 is a drawing of a towel wherein the novel steps of the invention are schematically set out.

Referring first to FIG. 1, a towel 11 is shown there comprising a blank base material or starting product 13 of towel cloth to which it is desired to graft an applique of lace trimming 15 in a preselected region 17, for example centered near a hem 19 of the towel 11. In the present embodiment, the starting product may be a towel, however other knit, woven or non-woven materials may be used. The lace trimming applique 15 is of a predetermined geometrical FIG. 21 and, according to the invention, is grafted onto the product 13 to become, at least visually speaking, an integral part of the towel 11.

In order to achieve this, following the steps of the method discribed in more detail hereinafter, the towel base product 13 is previously cut along a figure or shape 23 determined by the perimeter 21 of the lace trimming 15 and the material 27 cut out is thrown away as indicated by the arrows 25. The lace trimming is then centered exactly over or under the hole 29 left in the product 13 and joined thereto by a seam running around the slightly overlapping edges 21–23. In accordance with the invention, the amount of overlap between edge 21 of the lace trimming 15 and the edge 23 of the portion removed from the product 13 along the joint or seam is only about two or three millimeters accross, so that applying a conventional attractive embroidery four millimeters wide, for example, fully integrates the graft or applique 15 into the towel product 11 and provides a finishing touch with no visual defects. These measurements are generally on the minimum since wider overlaps may be embodied if desired.

Figure 2:
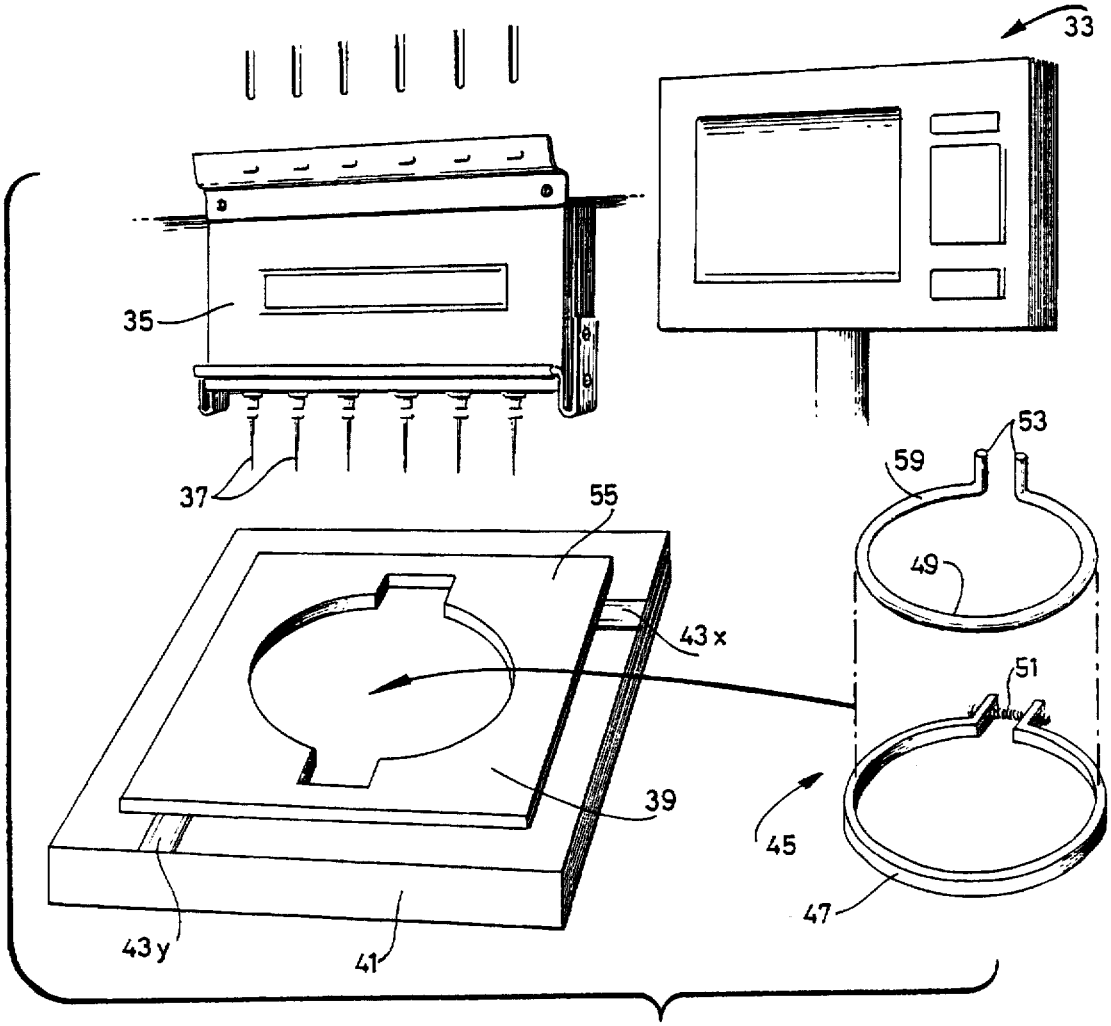
FIG. 2 is a schematic in perspective of a spindle-head and the working region associated therewith of an embroidering machine, also showing a hoop for the product in a dismantled is state.

FIG. 2 illustrates a part of an automatic programmed multihead embroidering machine 31, suitable for this job, such as model TMEF-H612 manufactured by Tokei Industrial Sewing Machine Co., Ltd. of Japan. The machine 31 is installed with twelve spindle-heads 35 electronically controlled by a programmed Tajima controller 33, although other means such as a Toyota Expert 820 system may be used alternatively. FIG. 2 only shows one of the twelve like heads 35 of the machine 31. Each spindle-head 35 is installed with six (or sometimes twelve) needles 37, each associated with a different spool of thread (not illustrated) for automatically embroidering with threads of different colours.

The twelve spindle-heads 35 are installed with the, say, six needles 37 of each directed to a general work region within a moving master frame 39 supported on a machine table 41. The frame 39 is moved over the flat table 41 by two actuators 43X and 43Y, which generate perpendicular translation directions from control signals received from the electronic controller 33. This controller 33 includes storage means, such as a programmable memory chip (not illustrated), for holding codes defining a path around the edges 21–23 in storage together with other program instructions for carrying out the initial lock-stitching and the finishing embroidery, as described hereinafter.

The product 11 is firmly and uniquely placed in the embroidering machine 31 by means of a removable shuttle frame or hoop 45 which may be uniquely set by means of an adapter 55 in the frame 39 the adapter and frame may be made as an integral piece if desired. This hoop 45 comprises an outer hoop part 47 and an inner hoop part 49 dimensioned to firmly hold the cloth of the product 11 so that the work region 17 is entirely within the circumference of the hoop 45. The outer hoop 47 is a part made of plastics, generally having a square cross-section, furnished with screw means 51 for finely adjusting the circumference thereof. The inner hoop 49 is made from a round metal bar bent nearly into a full circumference open between two ends 53 perpendicular to the plane of the circumference of the hoop 49. These ends 53 may be finger pressed towards each other to make the inner hoop 49 temporarily smaller so as to be able to force it over the product 13 and press it down inside the outer hoop 47 such that the product 13 is retained in between. Alternatively, a rigid closed hoop could be used for the inner hoop part which is pressed into the outer hoop part 47.

Each hoop 45 is removably set in the frame 39 by means of the individual adapter 55 fixed to the frame. The adapter 55 may be a generally rectangular flat piece of wood, plastics or other suitable material. The top face of the adapter 55 may be carved or moulded into the shape of the hoop 45. In the present embodiment, the outer hoop part 47 protrudes radially outwards where the adjustment screw 51 is, so that it may fit in the adapter in only one way, thus enabling the hoop 45 to be uniquely set in the adapter 55 and, therefore, relative to the spindle-head arrangement 35.

Figure 3A:
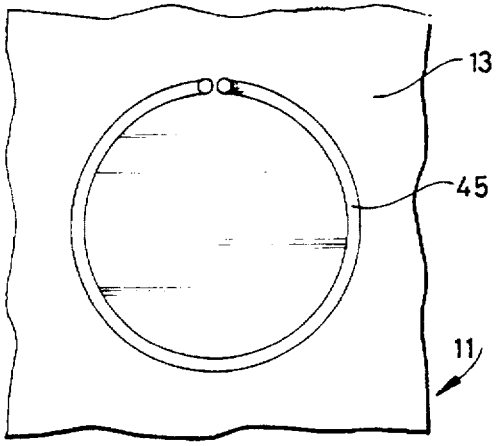
FIGS. 3A to 3E illustrate different steps of the method, FIG. 3E showing the finished product with the graft.
Figure 3B:
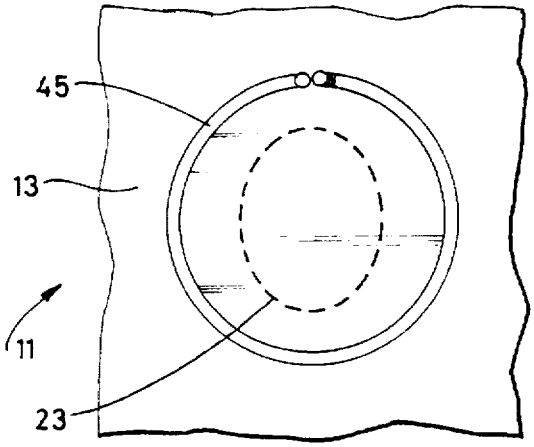

FIGS. 3A to 3E portray a sequence of method steps for carrying out the operation depicted in FIG. 1 with the machine of FIG. 2. In FIG. 3A, the base product 13 of the towel 11 is placed relatively taut inside the hoop 45 which is then assembled into the frame 39 of the embroidering machine 31. In FIG. 3B, the top face of the towel material 13 of the product 11 is marked with the FIG. 23 by means of a lock-stitching operation performed by the needles 37 of the spindle-head 35, according to a design previously stored in a chip read by the controller 33.

Figure 3C:
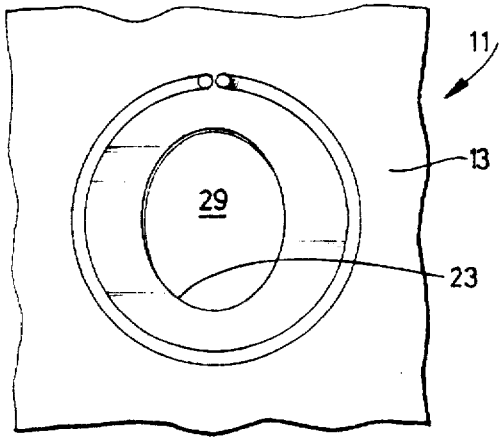

The hoop 45 is removed from the machine 31 together with the just marked product 13 and transferred to a press (not illustrated) where the lock-stitched mark 23 is visually aligned with a hollow die cut 57. Once the product 13 has been perforated by the die cut 57 as depicted in FIG. 3C, the hoop 45 is removed again from the press and reinstalled in the frame adapter 55 of the machine 31.

Figure 4:
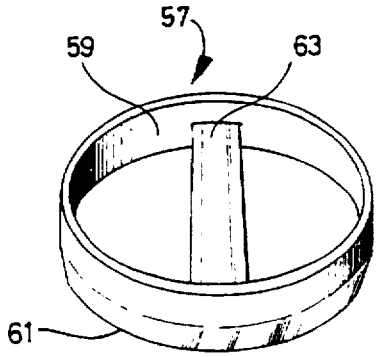
FIG. 4 shows an embodiment of a die cut suitable for the cutting-out step of the method of the invention.

FIG. 4 illustres a die cut 57 by way of example, manufactured from a steel strip 59 bent into the shape of the figure or design 23. In this example, the FIG. 23 is a simple oval shape, which is pretty attractive in the case of grafted towels 11, however any other desirable figure, such as in the shape of a heart, may be designed within the scope of the present invention. The bottom edge 61 of the strip 59 is sharpened to form a cutting edge and a cross strip 63 may optionally be welded in place inside the oval strip 59 to avoid the shape of the latter from becoming deformed with use and also to serve as a handle for facilitating installing and removing the hoop 45 from the press and the embroidering machine 31.

The invention is based on that the adapter 55 is static within the frame 39 of the machine 31 and that the hoop 45 fits exactly in the adapter 55 in only one way, as described hereinabove. Hence the hoop 45 holding the product 13 may be uniquely situated relative to the embroidery machine 31, making it inherently possible, by keeping the base product 13 permanently inside the hoop 45 and sufficiently taut to avoid any relative shift therein, to return the base product 13 to the embroidering machine 31 in exactly the same position it had relative to the spindle-head for the initial lock-stitching marking operation.

Figure 3D:
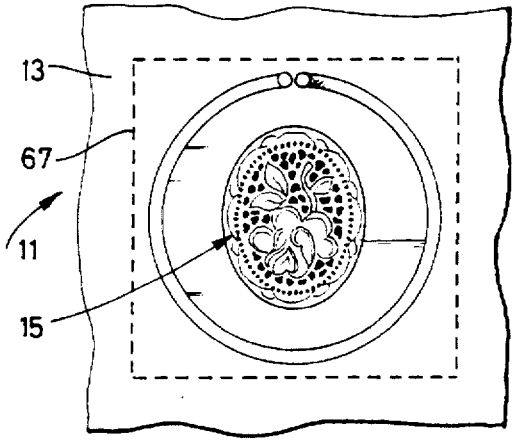
Figure 3E:
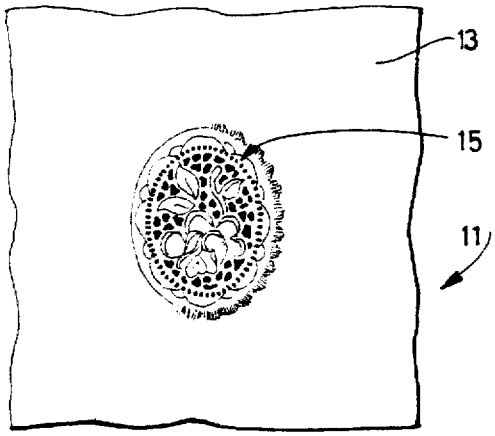

As set forth in FIG. 3D, the hole 29 punched out by the press is covered by the applique 15 to be incorporated, using a bridge 67 such as a sheet of paper or discardible material which is pasted with glue substance to hold the applique 15 in place over (or under) the hole 29 such that the edges 21 and 23 uniformly overlap preferably less than eight millimeters, more preferably just about two to four millimeters, all the way round. The spindle-head 35 is turned on again in this position to embroider a seam 65 all the way round the edges 21–23. The glue-paper bridge 67 allows the seam to be embroidered by the machine 31 without the applique shifting relative to the base material 13. The glue-paper 67 is removed thereafter leaving the towel 11 with the applique 15 definitively integrated thereinto, as may be seen from FIG. 3E.

Figure 3F:
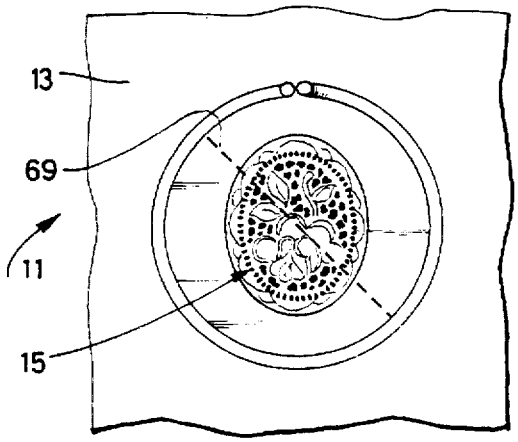
FIG. 3F illustrates an alternative step to 3D wherein a bridge is removed after a basting operation and before the final grafting seam is completed.

Alternatively, the bridge-paper 67 may be removed after tacking a baste 69 accross the applique 15 and base product 13, as shown in FIG. 3F, to hold the applique 15 in place over or under the hole 29 while the grafting seam 65 is embroidered.

In carrying out the invention on an industrial scale, the manufacturing steps may be entwined to avoid the machine 31 idling while the product is away at the press. That is, while the marked product 13 is undergoing the punching step shown in FIG. 3C, another product may be at the machine 31 undergoing the marking or joining step, extra hoops 45 being provided to this effect.

Of course, changes, variations and aggregations may be applied to the above-detailed embodiment, without departing from the scope nor the spirit of the invention. The same has been described by way of a preferred embodiment specifically for a towel product 11, however those skilled in the art may suit it to other applications or introduce modifications without departing from the purview of the invention as set forth in the appended claims. For example, the die cut 57 and the associated press may be replaced by cutting means incorporated into the structure of the machine 31 and functionally operated from the controller 33 under a pre-programmed sequence of instructions.

I claim:

1. A method for grafting an applique in a pre-selected region of a product, said applique having a preselected shape and size, said method comprising the steps of:

fitting said product into a hoop in a way that said region is entirely inside said hoop, removing a portion of material from said region of the product, whereby a hole is formed in said product having a same shape and slightly smaller size relative to said applique;

covering said hole with said applique such that said applique overlaps a strip of product material all the way round said hole;

joining said applique to the strip of overlapping material of said product; and wherein said steps of removing, covering and joining are carried out sequentially without removing or substantially loosening said product from said hoop.

2. A product grafted by the method of claim 1 comprising:

a base material; and at least one region having an applique grafted therein, the perimeter of said applique forming a geometric figure of a preselected shape;

wherein a portion of said base material is removed from said region, said removed portion defining an edge substantially having the same shape as said figure, and said applique is grafted onto said base material substantially in place of said removed portion and is joined to said base material substantially around said applique perimeter, wherein said edge of the portion removed from said base material and said applique perimeter overlap substantially uniformly all the way round and said applique is joined to said base material by a seam, the width of said seam being greater than the overlap between said applique and said base material.

3. The product of claim 2, wherein said seam is not more than 8 mm wide.

4. The product of claim 3, wherein said seam is not more than 4 mm wide and said overlap is less than 3 mm.

5. The product of claim 1, wherein said product is a towel.

6. The product of claim 5, wherein said product is a product of clothing or linen.

7. The product of claim 4, wherein said applique is lace trimming.

8. The product of claim 4, wherein said base material is substantially blank and said applique includes a design.

9. The method of claim 1, further including the step of marking a figure on said product substantially similar to said preselected figure, in between said fitting and said removing steps and wherein said steps of marking, removing, covering and joining are carried out sequentially without removing or substantially loosening said product from said hoop.

10. The method of claim 9, wherein said marking step and said joining step are carried out on an embroidering machine including frame means and stitching means, and said hoop in which the product is fitted is a removable hoop fitting into said frame; said marking step comprises:

fitting said removable hoop in a unique position into said frame and operating said embroidering machine to lock-stitch said figure on said product material.

11. The method of claim 10, wherein said removing step comprises:

removing said removable hoop from said frame;

punching out said said portion from said product material; and fitting said removable hoop into said frame back into said unique position.

12. The method of claim 11, wherein said punching step is carried out in a press including a die cut having a cutting edge of substantially the same shape and slightly smaller size than said applique, said punching step comprising:

registering said figure marked out in said region with said cutting edge; and operating said press to cause said die cut to punch out said portion.

13. The method of claim 10, further including using said embroidery machine, while said product is undergoing said removing step at said press, for carrying out said marking or said joining step on another similar product.

14. The method of claim 13, wherein said joining step comprises grafting said applique onto said product by embroidering a seam all the way around said applique.

15. The method of claim 13, wherein said seam is embroidered to cover substantially all said strip of overlapping material.

16. The method of claim 14, wherein said covering step includes, prior to embroidering said seam:

providing a bridge having a surface larger than said applique pasted with an adhesive substance;

removably adhering said applique to said surface such that a portion of said surface pasted with said adhesive substance is free;

placing said bridge across said hole such that said pasted portion contacts said product; and keeping said applique in place while said seam is embroidered.

17. A method for grafting an applique in a preselected region of a product, said applique having a preselected shape and size, said method comprising the steps of:

removing a portion of material from said region of the product, whereby a hole is formed in said product having a same shape and slightly smaller size relative to said applique;

covering said hole with said applique such that said applique overlaps a strip of product material all the way round said hole;

placing and removably adhering a bridge across said applique such that parts of said bridge extend beyond said applique and contact parts of said product, said bridge having a surface facing said applique pasted with an adhesive substance such that said applique is temporarily affixed to said product over or under said hole; and grafting said applique onto said product by embroidering a seam all the way around said applique, and said bridge is removed after completely embroidering said seam.

18. The method of claim 16, wherein said bridge is removed after completely embroidering said seam.

19. The method of claim 17, wherein, in between said placing and said grafting steps, a baste is tacked accross the applique beyond two edges thereof, whereafter said bridge is peeled off said applique and said product before said seam is embroidered.

20. The method of claim 17, wherein said bridge comprises a sheet of paper or cardboard material.

* * * * *